United States Patent [19]

Reverchon et al.

[11] 4,257,726

[45] Mar. 24, 1981

[54] APPARATUS FOR STORING AND EMPLACING FLOOR PLATES, PARTICULARLY FOR AMUSEMENT RIDES

[76] Inventors: Michel Reverchon; Christian Reverchon, both of Route de Courbuisson, Samois sur Seine (Seine et Marne), France

[21] Appl. No.: 968,968

[22] Filed: Dec. 13, 1978

[30] Foreign Application Priority Data

Dec. 13, 1977 [FR] France ..... 77 37525

[51] Int. Cl.[3] ..... B65G 57/28

[52] U.S. Cl. ..... 414/104; 414/107; 414/330; 414/10; 52/122; 198/473; 104/53

[58] Field of Search ..... 104/1, 3, 53; 52/64, 52/122; 198/409, 473, 489; 414/104, 107, 330, 567

[56] References Cited

U.S. PATENT DOCUMENTS

| | | | |
|---|---|---|---|
| 3,184,042 | 5/1965 | Rutkovsky et al. | 198/473 |
| 3,521,763 | 7/1970 | Heije et al. | 414/33 C |
| 4,093,083 | 6/1978 | Klaus | 414/107 |

*Primary Examiner*—Richard A. Bertsch

*Attorney, Agent, or Firm*—Young & Thompson

[57] ABSTRACT

Apparatus for storing plate-like members in a compact volume in upright position, and for removing those members from storage and laying them in a horizontal series and returning the members to storage, is useful for example in the laying of a support for supporting amusement vehicles, for example in a traveling fair or circus. A vertically swinging assembly separates the members one by one from storage and swings them down to horizontal position and then pushes them so that each member pushes in front of it, along the trackway, the members previously deposited. The members are stored in pendant relationship on inclined tracks that terminate downwardly in an abutment, which ensure their sequential but groupwise feeding to the position at which the vertically swinging assembly engages them, lifts them out of contact with the abutment, and then lowers them.

7 Claims, 1 Drawing Figure

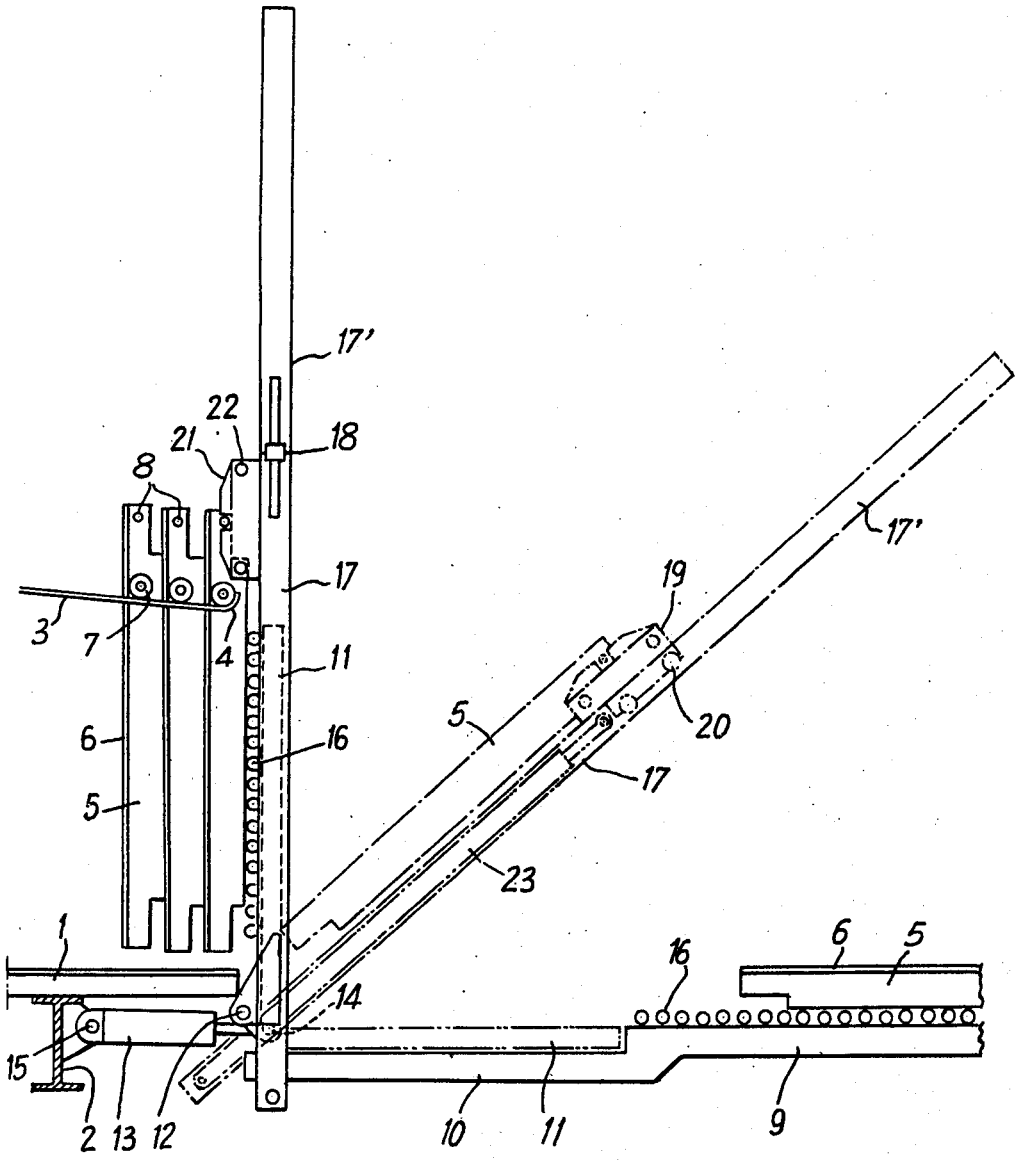
17'
22
21
18
8
17'
17
19
3
7
4
11
20
5
6
16
17
5
23
1
6
5
16
14
15
2
13
12
10
11
9

APPARATUS FOR STORING AND EMPLACING FLOOR PLATES, PARTICULARLY FOR AMUSEMENT RIDES

The present invention relates to amusement rides and particularly those of the "auto-skooter" type, comprising a train of juxtaposed elements supported on a trackway, the length of each element corresponding to the width of the trackway. These elements rest on parallel beams or joists. The flooring or deck elements each comprise a supporting structure and a conductive metal surface plate, and are heavy and their discharge from the transporting means and their emplacement and retrieval as well as their reloading on the transportation means, require lifting and manipulating means which are generally constituted by apparatus in the nature of tackle rolling on two longitudinal beams of the cover over the amusement device.

In the case of an amusement device in which the deck plate of the transport means for the elements is incorporated in the flooring of the trackway, for example in a device of the type described in French Pat. No. 71.34397, it has been proposed to bend a portion of the track elements downwardly to form the sides of the transporting means. However, this limits the length of the trackway and it is necessary to supplement this portion by structure such that the problem is only partially solved. Moreover, the use of the longitudinal beams of the covering as support for these heavy elements, requires extra reinforcement.

The present invention has for its object to simplify the storage and the emplacement and reloading of the deck plates in an amusement device or the like.

The invention will be described in detail hereinafter with reference to the accompanying drawing, whose single FIGURE is a schematic side elevational view of one embodiment of apparatus according to the invention for emplacing and retrieving the floor plates of an amusement device.

In the embodiment illustrated, the amusement device comprises a central support member comprising a deck 1 having an appropriate width, and a length, perpendicular to the plane of the drawing, equal to the width of the track of the amusement device. This desk is carried by support 2 which also carries upright side walls (not shown) perpendicular to deck 1 and parallel to the plane of the drawing. Generally speaking, the device is symmetrical and the deck of the trackway of the amusement device is disposed on either side of the central portion 1. In the drawing, there is shown only the instance, which is also possible, in which the trackway is provided only on a single side of the storage structure for the deck elements, i.e., the transporting means. On the two side walls (not shown), in confronting relation with each other, are secured inclined rolling tracks 3, parallel to each other and having at their lower ends abutments 4.

The deck elements comprise in known manner a supporting structure 5 whose length perpendicular to the plane of the drawing is equal to the width of the trackway and whose width is for example about four feet. On the upper surface of the carrying structure is fixed a steel plate 6 so that the deck member may constitute a portion of the electrically conductive path of an electrical vehicle of the amusement device. These deck elements are stored during transportation above the deck 1 and are suspended from lateral rollers 7 between two rolling tracks 3 of the two side walls of the transporting means. The deck elements also have on each of their two end faces a lug 8 which is used for their manipulation but which may also serve, upon cooperation with means (not shown) fixed to the other end of each lateral face, to ensure the interconnection of the deck elements once they are emplaced on the track.

The track also comprises, in known manner, a certain number of parallel beams 9 distributed along the entire length of the track at a level to receive the deck elements 5. At their end adjacent deck 1, the beams 9 have a recessed portion 10 to receive the member 11 which is shown in phantom line in the lowered position in the recess defined by portion 10. This member 11 is pivotally mounted on the side of the structure 2 about an axis 12 and its swinging movement between the raised position shown in dashed line and the lowered position shown in phantom line, is effected by one or more jacks 13 pivotally mounted between an axle 14 fixed to member 11 and an axle 15 carried by the structure 2. The member 11 is constituted generally by profiles which prolong the beams 9 and may be in the form of two members interconnected by crosspieces.

To facilitate the movement of the deck members 5 along the beams 9 and member 11, the upper surfaces of beams 9 and the corresponding surface of the member 11 are provided with rollers 16 which may have the general form of roller trains.

The manipulating means itself for the deck elements is constituted by two slideways 17 preferably comprised by C profiles which are articulated on the same axis 12 as the member 11 and affixed to the same at the two ends thereof in a manner to swing together therewith while passing outside of the end faces of the deck elements. So as to have a sufficient length while avoiding interfering with other operation of the device, the slides are constituted in two C sections, comprising a base 17 and an elongation 17' interconnected by a lateral hinge 18 and corresponding securement means on the opposite side of the slideway. The slideways 17 serve to guide carriages 19 one associated with each slideway and carried by rollers 20, these carriages each carrying two resilient abutments 21 articulated about axes 22. These two abutments are spaced apart by a gap that receives lug 8 on the lateral side of a deck element. Movement of the carriages 19 is under control of a jack 23 disposed in each slideway 17.

The operation of the device described above is as follows:

Upon arrival of the amusement device at the place where it is to be assembled, the structure 2 is leveled and then the beams 9 are emplaced and leveled. The slideways 17—17' are fastened to the member 11 if they are not already in that condition. The carriages 19 are in the illustrated position with the members 21 receiving between them the lugs 8 of the first deck element. Jack 23 is then extended a few inches to raise the rollers 7 from the abutment 4, and then the jacks 13 are activated to swing the member 11 and slideways 17 downwardly outwardly, thereby carrying along with them the first deck element 5 resting on the rollers 16 of the member 11.

At the end of downward swinging movement, when the members 11 are disposed in the recessed portion 10 of the beams 9, the rollers 16 on the members 11 are at the same level as those on the beams 9. Jack 23 is then extended to cause the deck member 5 to move from the rollers on 11 to the rollers on 9, at least until deck 5 clears member 11. Then the members 21 are swung about their axes 22, to free the lugs 8; and carriage 19 is withdrawn to the left as seen in the FIGURE, until it has sufficiently cleared the deck 5 from which it was just disengaged.

The jacks 13 are then actuated to swing the assembly back to the full line position shown in the FIGURE, in which it is ready to receive the next deck plate and repeat the operation, the remaining deck plates 5 having in the meantime rolled down to the full line position shown in the FIGURE. Thus the track or roadway is built up element by element, each element 5 pushing forward the previously deposited ones.

When the last element 5 is lowered into place, it will exactly fill the remaining space between the relatively fixed deck 1, and the immediately previous deck member 5, so that deck 1, with the series of thus-deposited deck members 5, will form a continuous surface.

The retrieval and reloading of the deck members is of course carried out by the opposite operation from that just described; and the deck members are stacked in vertical position, one by one, on the rails 3 until the roadway has been completely disassembled and all the members 5 are stacked in the vertical position shown in the drawing, overlying the relatively stationary deck 1.

The slideway portions 17' can then be swung down to collapsed position and a compact and easily transported assembly is thus achieved.

From a consideration of the foregoing disclosure, therefore, it will be evident that the initially recited object of the present invention has been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. Apparatus for storing a plurality of plate-like members in upright position and for delivering them from said upright position to a horizontal position and for returning them from said horizontal position to said upright position, comprising a support, a pair of spaced rails on said support for storing a plurality of said members in upright position, said members having elements at both ends that ride on said rails and by which said members are suspended from the rails between the rails, a vertically swinging assembly mounted on said support and engageable with said members to swing said members downwardly one by one into a horizontal position and to return said members one by one to said upright position, track means for receiving said members in said horizontal position, and pusher means mounted on said assembly for lifting each said member off said rails in an upright position of said assembly and for pushing said members along said track means in a horizontal position of said assembly.

2. Apparatus as claimed in claim 1, said rails being downwardly inclined in the direction in which said members are swung downwardly by said assembly, whereby said members, upon moving along said rails, are fed by gravity to a position in which they can be received and lowered one by one by said assembly.

3. Apparatus as claimed in claim 1, said elements comprising rollers on each said member, said rollers being disposed above the center of gravity of said members when said members are in upright position, said rollers riding on said rails.

4. Apparatus as claimed in claim 1, said vertically swinging assembly comprising a pair of slideways spaced apart a distance sufficient to clear said track and members upon downward swinging movement, said pusher means comprising carriage means slidable lengthwise on and between said slideways, means on said carriage means for engaging upper portions of said members when said members are in said upright position, and means acting on said carriage means to move said carriage means along said slideways.

5. Apparatus as claimed in claim 4, said acting means comprising jacks acting between said assembly and said carriage means.

6. Apparatus as claimed in claim 1, and abutment means at the ends of said rails adjacent said assembly, said pusher means lifting each said member off said rails a distance to clear said abutment means before swinging said members to horizontal positions.

7. Apparatus as claimed in claim 6, said rails being downwardly inclined in the direction in which said members are swung downwardly by said assembly, whereby said members move along said rails by gravity until they encounter said abutment means.

* * * * *